US007703726B2

(12) United States Patent
Harrison et al.

(10) Patent No.: US 7,703,726 B2
(45) Date of Patent: Apr. 27, 2010

(54) HEIGHT-ADJUSTABLE FURNISHING SYSTEM

(76) Inventors: Joseph Hunter Harrison, 5519 Pebble Garden Ct., Greensboro, NC (US) 27407-5437; Mary Lee Harrison, 5519 Pebble Garden Ct., Greensboro, NC (US) 27407-5437

( * ) Notice: Subject to any disclaimer, the term of this patent is extended or adjusted under 35 U.S.C. 154(b) by 695 days.

(21) Appl. No.: 11/580,678

(22) Filed: Oct. 13, 2006

(65) Prior Publication Data

US 2007/0089648 A1 Apr. 26, 2007

Related U.S. Application Data

(60) Provisional application No. 60/726,629, filed on Oct. 14, 2005, provisional application No. 60/837,489, filed on Aug. 14, 2006.

(51) Int. Cl.
*F16M 11/38* (2006.01)

(52) U.S. Cl. ..... 248/166; 248/163.1; 248/188.1; 248/188.6

(58) Field of Classification Search ..... 248/398, 248/166, 170, 171, 439, 188.1, 188.6, 585, 248/281.11

See application file for complete search history.

(56) References Cited

U.S. PATENT DOCUMENTS

| | | | | |
|---|---|---|---|---|
| 6,038,986 | A * | 3/2000 | Ransil et al. | 108/145 |
| 6,688,634 | B2 * | 2/2004 | Noffsinger | 280/651 |
| 6,863,270 | B2 * | 3/2005 | Bartley, Jr. | 269/37 |
| 2003/0098559 | A1 * | 5/2003 | Reese | 280/32.6 |
| 2007/0001076 | A1 * | 1/2007 | Asamarai et al. | 248/281.11 |

* cited by examiner

*Primary Examiner*—Amy J Sterling
(74) *Attorney, Agent, or Firm*—Timothy M. Barlow

(57) ABSTRACT

A height-adjustable furnishing system includes a base component, a plurality of legs, a height adjustment mechanism, and a platform component. The base has a planar bottom surface and a top surface with a plurality of attachment points for pivotally attaching two, three or four legs. The height-adjustment mechanism is adjustably attached between the base component and at least one of the plurality of legs, or between a forward leg and a rear leg. A platform component is pivotally attached to the plurality of legs to form a parallelogram linkage when viewed from the side. The height-adjustment mechanism may include a gas spring, a cam clamp, a travel block, a release lever, a cable release, a release trigger and may also be hand- or foot-operated. The entire system folds to a generally planar configuration for storage. The legs are erect when they are approximately 10 degrees from vertical.

20 Claims, 13 Drawing Sheets

HEIGHT-ADJUSTABLE FURNISHING SYSTEM

PRIORITY DATA

This application claims benefit of U.S. Provisional Patent Application Ser. No. 60/726,629, filed Oct. 14, 2005, entitled Vertically Adjustable Healthcare Table and Walker, and U.S. Provisional Patent Application Ser. No. 60/837,489, entitled Vertically Adjustable Highchair, filed on Aug. 14, 2006, and are hereby incorporated by reference.

BACKGROUND OF THE INVENTION

1. Field of the Invention

The present invention relates to an adjustable height furnishing system, and more particularly to a chair or table with adjustable legs and tops.

2. Description of the Related Art

Adjustable furniture is all around us. Desk chairs are often suspended on a gas spring column which allows the chairs to swivel and to be raised and lowered. Such chairs might even include a reclining feature or adjustable-height armrests. This is a great benefit to those who spend long hours at a desk, but there are innumerable other locales where improved ergonomics and adjustability is desired.

Simply raising a chair up or lowering it is fine, but if the chair's legs or base prevent the chair from approaching a table or chair, then the height adjustment is not so useful.

Tables can benefit from adjustability too. A table top that can be adjusted down and forward to be used while seated at a sofa or lounge chair allows use of the table and associated items on the table (i.e.: food, computer, highchair, drawing materials, grooming items, etc.) while seated comfortably in a chair designed for relaxation. The elderly, infirm or others of limited mobility could also benefit from a table or highchair or work surface that can be easily raised, lowered, or moved closer.

Thus a height-adjustable furnishing system, which solves the aforementioned problems, is desired.

SUMMARY OF THE INVENTION

The height-adjustable furnishing system includes a base component having a top surface and a bottom surface. The bottom surface is generally planar and has a plurality of attachment points incorporated into it. The top surface is parallel to the bottom surface and also has a plurality of attachment points incorporated into it. A plurality of leg members are pivotally attached to the base component at the attachment points, and a height-adjustment mechanism is adjustably attached between the base component and at least one of the plurality of legs. In the case of a two leg mechanism, the adjustment mechanism, such as a gas spring, is attached between the front leg and the rear leg, and is not attached to the base. A platform component is pivotally attached to the plurality of legs. Numerous variations are possible in mounting the gas spring, such as between a forward leg and a rear leg, between a leg and a tabletop or platform, or between a leg crossmember and a leg, base or tabletop.

In all embodiments, the base, legs and platform form a parallelogram linkage. The number of legs can be two or more, but are typically two or four. The height-adjustment mechanism may be a standard gas spring with a friction lock. In another embodiment, the height-adjustment mechanism is a gas spring with an integrated travel block. The integrated travel block may be accompanied by a detent to prevent the legs of the furnishing from lowering completely to a position that is parallel with the floor (typically a stored position) without being overridden.

In one embodiment, the height-adjustment mechanism comprises a release lever. The release lever is particularly applicable to the friction lock mechanism. In another embodiment, the height-adjustment mechanism comprises a cable release. The cable release is particularly applicable to the gas spring height-adjuster with integrated travel block. In one embodiment, a manual detent for the height-adjustment mechanism can be overridden by foot-operation. In the same embodiment, the manual detent for the height-adjustment mechanism is gravity-operated. In one embodiment, such as TV Trays, the positioning of the gas spring(s), at an angle that is not parallel to the legs, holds the table adjustably open and also holds the table closed when folded for storage.

The legs are adjustable between zero degrees and ninety degrees from parallel with a floor, particularly when the height-adjustment system is not attached. However, when the gas springs are attached, the legs are positioned approximately 10 degrees forward of vertical at the highest adjustment point to provide some gravitational influence for adjustment. The entire system can be folded into a generally planar configuration for storage. In one embodiment, one or more pairs of the plurality of legs are parallel and rest, one on top of and against the other, for most of their length while in a stowed position. The plurality of legs may be made from C-channels that are coplanar and open toward each other to create a chamber between and inside the legs. In such an embodiment, the chamber between the plurality of legs envelopes a gas spring height adjustment system. In this embodiment, the gas spring height adjustment mechanism is concealed from view in the chamber between the plurality of legs when the unit is folded for storage.

Within the parameters of the furnishing system which is defined herein, many uses can be accomplished, including the following: a desktop-style computer table, which is typically a four leg configuration with accommodations for a keyboard and mouse, a laptop-style computer table, which is typically a two leg configuration, a baby highchair seat with associated food tray, a sewing machine table, a drafting, art and hobby table with an angle-adjustable top, a video table for holding a television, movie player and video game console and controllers, a food tray or TV tray, for holding food and drinks, pen and notepad, day planner, etc., a healthcare table for use with wheelchairs having a two leg configuration with a wide "U" shaped base for clearing wheelchair bases and able to hold a cafeteria-style food tray, personal grooming supplies, etc. In all cases, the furnishing has adjustability both horizontally and vertically, facilitated by a radial travel of the legs, controlled by an adjustment mechanism. In all cases, the adjustment mechanism of the furnishing facilitates not only height adjustment when the furnishing is in use, but also facilitates folding of the furnishing for storage and shipping. The ability to fully fold the furnishing for shipping provides a distinct advantage to the manufacturer, as the furnishing can be assembled completely or almost completely at the manufacturing facility, then folded and boxed for shipping and sale. When the consumer receives the product, they simply remove the furnishing from the box and un-fold the furnishing, accomplish any minor assembly of accessories (if required) and the process is complete. No detailed assembly of the furnishing is required by the end user, and the product is shippable via most standard courier providers.

Accordingly, it is a principal object of the invention to provide a height-adjustable chair that provides vertical and horizontal adjustment simultaneously.

It is another object of the invention to provide a height-adjustable table that provides simultaneous horizontal and vertical adjustment.

It is a further object of the invention to provide a free-standing height-adjustable furnishing system that includes legs or support members that remain parallel throughout their adjustment range.

It is a further object of the invention that the legs of the apparatus are leaning forward approximately 10 degrees off of vertical when the apparatus is at the highest adjustment point. This angle of the legs off of the vertical provides a small amount of gravitational influence to make pivoting of the platform downward require less torque.

Still, another object of the invention is to provide a height-adjustable furnishing system which folds flat for storage and shipping.

It is an object of the invention to provide improved elements, and arrangements thereof for the purposes described which is inexpensive, dependable and fully effective in accomplishing its intended purposes.

These and other objects of the present invention will become readily apparent upon further review of the following specification and drawings.

DETAILED DESCRIPTION OF THE PREFERRED EMBODIMENT

The present invention is directed to a height-adjustable furnishing system which may be equipped to maximize their utility to various consumer groups.

Figure 1:
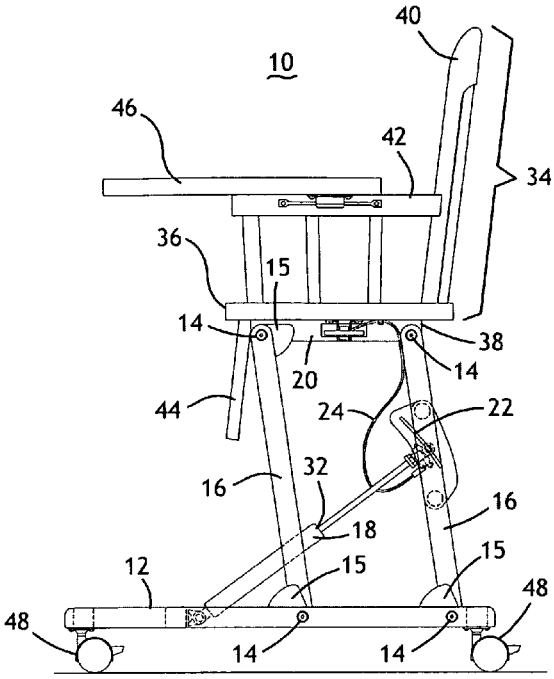
FIG. 1 is a side view of an adjustable-height baby highchair, according to the present invention.
Figure 2:
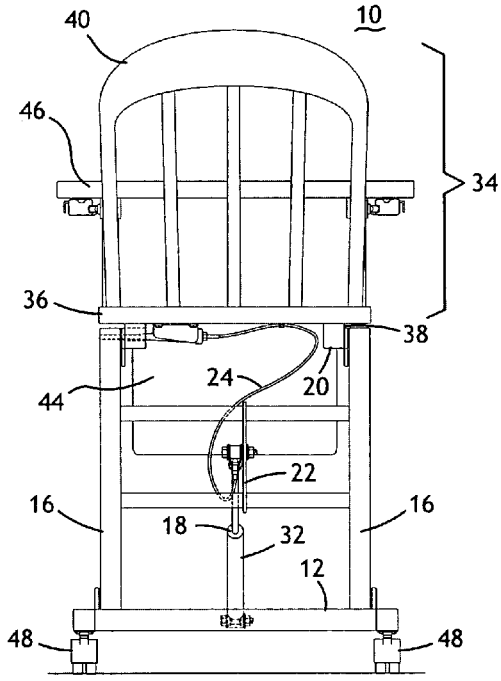
FIG. 2 is a rear view of an adjustable-height baby highchair, according to the present invention.

FIGS. 1 and 2 show side and rear views of a height-adjustable baby highchair 10 that includes several major components. The base component 12 includes a top surface and a bottom surface. The bottom surface is generally planar and faces or contacts the floor or another substantially flat surface. The top surface of the base component includes a plurality of attachment points 14. A plurality of leg members 16 are pivotally attached to the base component 12 at the attachment points 14. The pivots may be fixed axles in combination with friction reducing devices such as bushings or bearings or some combination. A pinch guard 15 is included at each attachment point where a potential pinch point exists 14 to prevent fingers from being pinched between the base 12 and legs 16. A height-adjustment mechanism 18 is adjustably attached between the base component 12 and at least one of the plurality of legs 16. A platform component 20 is pivotally attached to the plurality of legs 16.

The base 12, legs 16 and platform 20 form a parallelogram linkage. When the platform 20 is adjusted via the height-adjuster 18, it stays parallel to the base 12, and each of the legs 16 stays parallel to the other legs 16. Thus, if the base 12 is level, the platform 20 stays level throughout the adjustment range. Of course, the base 12 needs to be long enough to support the platform 20 at its lowest adjustment position to prevent tipping.

Numerous variations can be made on this principle. There can be two to four legs 16, and several different types of height-adjusters 18 can be used. In one embodiment, the height-adjuster 18 includes a gas spring, as shown in FIG. 1. Also included is a locking mechanism 22 with a cable release 24. A gas spring uses a compressed gas to provide enough resistance to keep the platform 20 from falling uncontrollably when the height adjuster 18 is released via the cable release 24. The gas spring provides many advantages over mechanical springs, including damping qualities that prevent continuous oscillations and vibrations and speed-controlled extension and compression.

In another embodiment, the height-adjustment mechanism 18 comprises one or a plurality of standard gas springs and a friction lock 26. In another embodiment, the height-adjustment mechanism 18 comprises a travel block that prevents adjustment beyond a mechanical limit or provides a number of detents or stops within a prescribed range. The height-adjustment mechanism 18 may also include a release lever 30, which can be hand- or foot-operated.

In another embodiment the legs 16 are adjustable between zero degrees and ninety degrees from parallel with a floor. Depending on the type height-adjuster 18 employed, the amount of adjustment with the range may be infinite. The entire system 10 can be folded into a generally planar configuration.

Within the height-adjustable furnishing system, the baby highchair 10 is unique for its seat 34. The baby chair seat 34 is comprised of several components: the baby seat base 36, baby seat rails 38, baby seat back 40, baby seat armrests 42 and foot guard 44. The food tray 46 is mounted atop the armrests 42 and is easily removed for cleaning and child egress. The underside of the platform 20 may include the rails 38 on the left and right sides with mounting appropriations to secure the pivoting mounts of the four pivoting legs 16. The platform 20 may be incorporated directly into the baby chair base 36, or vice versa to eliminate one component if desired. In the embodiment shown, the combination of the seat base 36 and the seat rails 38 are equivalent to the platform 20. The seat base rails 38 may alternatively be four individual protrusions that are capable of providing pivoting fastening points for the legs 16, such as four pillow block style ball bearing housings.

The foot guard 44 is mounted to the forward underside of the chair seat 34. This flat surface keeps the child's legs from getting under the chair seat 34 and injuring himself or possibly damaging the locking mechanism 22. The foot guard 44 does not have any ledge on the bottom which a child could stand on.

The base 12 is a generally rectangular structure and is shown with four pivoting, locking, dual-wheel casters 48 attached to it, with one caster 48 on each corner of the base 12. The four casters 48 allow the unit to be maneuvered into position for use at different locations within a home or nursery environment. The casters 48 can be locked to prevent rolling.

Figure 3:
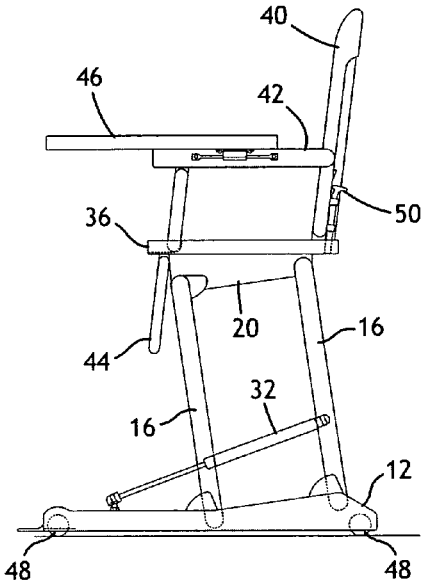
FIG. 3 is a side view of an adjustable-height baby highchair, according to the present invention.
Figure 4:
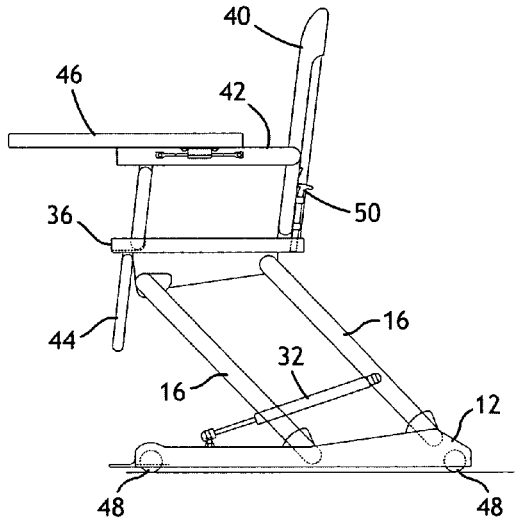
FIG. 4 is a side view of an adjustable-height baby highchair, partially lowered, according to the present invention.
Figure 5:
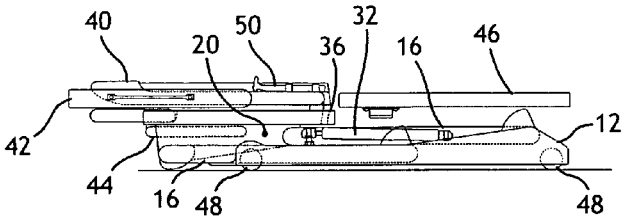
FIG. 5 is a side view of an adjustable-height baby highchair, folded flat, according to the present invention.

FIGS. 3-5 show side views of the height-adjustable baby chair 10 with the ability to be folded flat. The locking mechanism 22 is omitted for clarity. FIG. 3 shows the baby chair 10 in its highest position. The legs 16 are leaning forward approximately 10 degrees when the apparatus is at the highest adjustment point. This angle of the legs off of the vertical provides a small amount of gravitational influence to make pivoting of the seat 34 downward require less torque.

FIG. 4 shows the baby chair 10 lowered about halfway through its available travel. FIG. 5 shows the entire baby chair 10 folded flat. The seat back release 50 is disengaged from the baby chair base 36 so that the seat back 40 can fold forward against the base 36. The food tray 46 is removed from the armrests 42 to make room for the seat back 40, and subsequently stored above the legs 16 which are now in a horizontal orientation. The entire baby chair 10 is easily stored beneath a bed or sofa, against a wall, or in a closet.

FIGS. 6A-F show detailed side views of an automatic lock 52 mechanism that can be used with the height-adjustable furnishing system. With some furnishings, such as the baby chair 10, it is not desirable to have the chair 10 free to collapse to the folded position simply by releasing the locking mechanism 22. Such an act could injure the baby, depending on the weight of the baby and the strength of the height adjuster 18 or gas spring 32. It would be desirable to have a predetermined position at which the chair 10 cannot go lower without being overridden. This is purpose of the automatic lock mechanism 52.

Figure 6A:
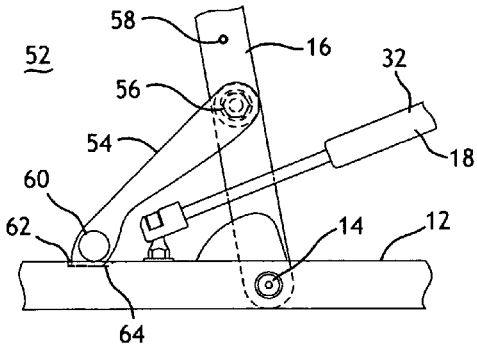
FIGS. 6A-F show detailed side views of an automatic lock mechanism for the height-adjustable furnishing system, according to the present invention.

FIG. 6A shows the lock mechanism 52 with the chair 10 in its standard upright and locked condition. The lock mechanism 52 includes a lock arm 54 that is attached to a leg 16 at a pivot 56. The pivot 56 permits the arm 54 to move freely under the influence of gravity, and may include a spring to bias the arm 54 counterclockwise in this view. A stop pin 58 is attached to the leg 16 to prevent the arm 54 from rotating an excessive distance away from contact with the chair's base 12. This is particularly important where the arm 54 pivots only due to gravity. A foot peg 60 extends out from the arm 54 and allows the user to quickly override the lock 52 to lower the chair 10 beyond the lock's limits. An angular catch 62 is incorporated into the end of the arm 54 and engages an angular notch 64 cut into the base 12. A squared profile of both the catch 62 and the notch 64 are sufficient to prevent the chair from lowering without permission.

Figure 6B:
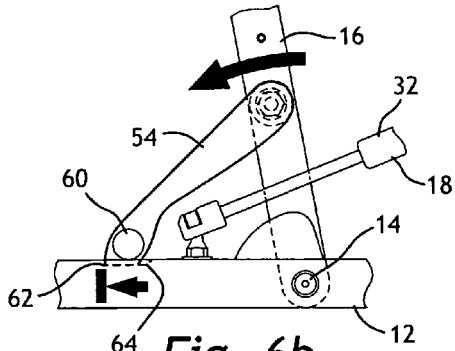
Figure 6C:
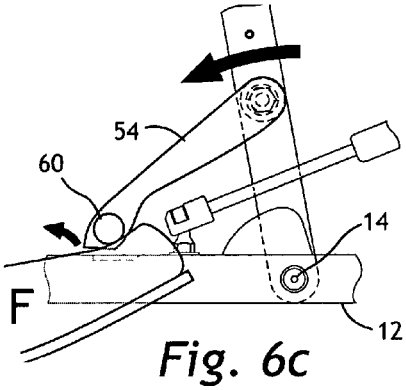

FIG. 6B shows the catch 62 in full engagement with the notch 64. FIG. 6C shows the arm 54 being released from the locked position. A user's foot F lifts the foot peg 60 to disengage the catch 62 from the notch 64. At this time the chair 10 can be adjusted to a lower position.

Figure 6D:
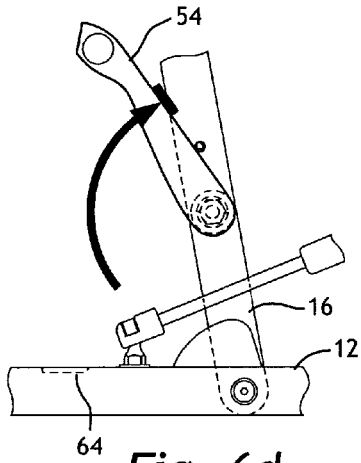
Figure 6E:
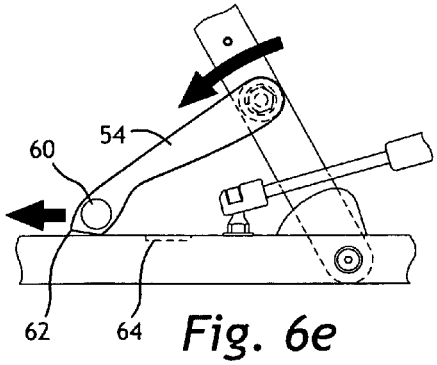

FIG. 6D shows that the arm 54 cannot be over-rotated. The stop pin 58 mechanically prevents the arm 54 from going any further. As the chair 10 is lowered, the catch 62 and notch 64 are no longer capable of mating, so the arm 54 can be released to drop back against the base 12. This is shown in FIG. 6E. The arm 54 will ride along the base 12 without impeding the chair's lowering.

Figure 6F:
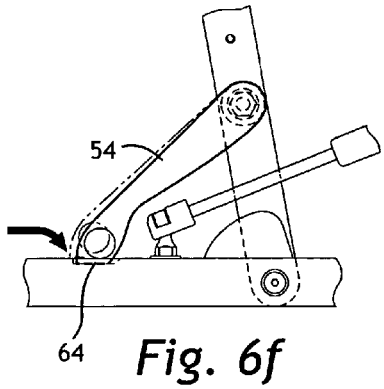

FIG. 6F shows that to engage the locking arm 54 again, the user simply raises the chair 10 to a more upright position and the catch 62 will simply fall into and engage the notch 64. Locking is complete. For more utility, the locking arm 54 may include a catch 62 that has a plurality of angular projections, while the notch 64 may be elongated along the base 12 and include a plurality of matching engagement surfaces. In this manner a large number of predetermined mechanical stops can be built into the chair 10.

Figure 7A:
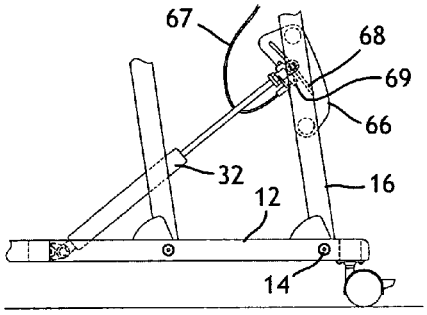
FIGS. 7A-D show detailed views of an adjustment mechanism for the height-adjustable furnishing system, according to the present invention.
Figure 7B:
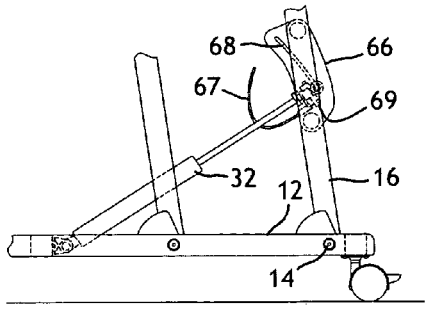
Figure 7C:
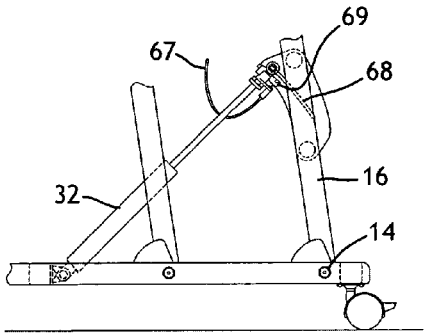

FIGS. 7A-C show a detailed view of an adjustment mechanism that was shown in FIGS. 1 and 2. An adjustable gas spring mount 66 is attached adjacent to the legs 16 at the rear of the chair 10. The gas spring mount 66 includes a mildly-arced slot 68 into which one end of the gas spring 32 is attached. FIG. 7A shows the gas spring 32 attached in the middle of the arced slot 68, corresponding to a medium load on the chair 10. The gas spring 32 shown in FIGS. 7A-D all include a cable release mechanism 69 that acts as the interface between the release cable 67 and the gas spring 32. A user operates a release lever or trigger at the other end of the cable and thereby controls the gas spring 32.

FIG. 7B shows the gas spring 32 attached to the arced slot 68 at the point closest to the attachment point 14 for the rear legs 16. This is the position of least mechanical advantage and is appropriate for the lightest loads upon the chair 10.

Figure 7D:
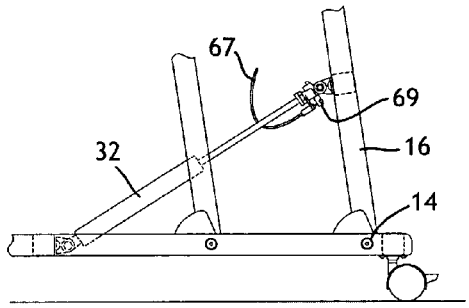

FIG. 7C shows the gas spring 32 attached to the arced slot 68 at the point farthest from the attachment point 14 for the rear legs 16. This is the position of greatest mechanical advantage and is appropriate for the heaviest loads upon the chair 10. FIG. 7D shows the gas spring 32 attached to the chair 10 in a nonadjustable manner.

Alternatively, a plurality of mounting points for gas springs 32 may be installed on one or both rear legs 16 to provide some adjustability to the angle of the gas spring 32 in reference to the chair 10. One or more gas springs 32 can be used simultaneously, preferably in a symmetric manner. Gas springs 32 are available in a wide range of power levels so that an appropriate combination of gas spring 32 and mounting point or mounting point adjustments can be found for any load. The higher the angle of the gas spring 32, the more weight is required to lower the chair seat 34. Likewise, multiple mounting locations for the gas spring 32 on the base 12 can help the user maintain an approximate 10 degree angle off of vertical for the legs 16 at the highest adjustment point. Modification of the spring angle in reference to the apparatus can be used to assist in accommodating the weight of children as they grow heavier and can also be used to accommodate different weights of equipment (i.e. computer equipment, video equipment, etc . . . ) on tables that are designed to facilitate use of these types of equipment.

Figure 8A:
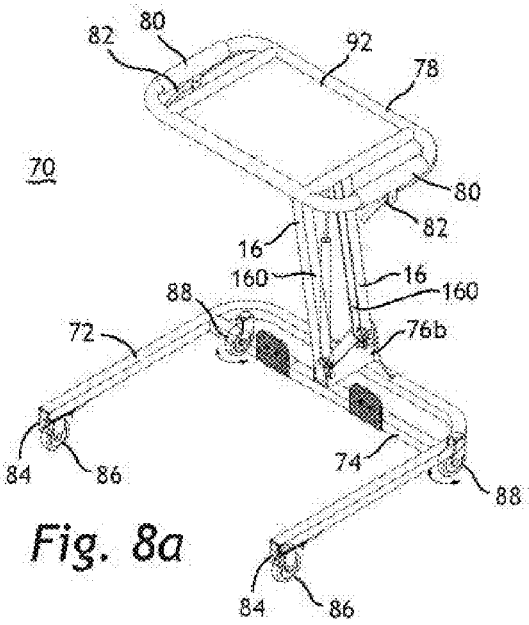
FIGS. 8A-B are perspective views of a two-legged, adjustable-height TV table, according to the present invention.
Figure 8B:
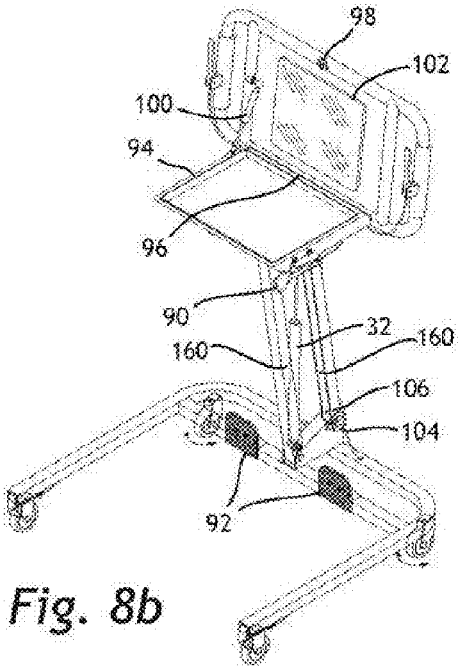

FIGS. 8A-B show a vertically adjustable healthcare table and walker 70. This product, hereinafter referred to as the walker 70, functions as a portable and height-adjustable healthcare table for use with wheelchairs and other types of seating. The walker 70 also serves as a height-adjustable walker to aid those who have difficulty walking. The walker 70 can be adjusted infinitely within an approximate 40 degree range of travel. The walker 70 can also be collapsed to a flat condition for stowage.

The walker 70 includes a base 72, which differs slightly from the base 12 for the baby highchair 10 because the walker 70 has only two legs 16, which are centrally located. The base 72 is generally U-shaped and includes a reinforcing cross-member 74 near the inside of the U. The base 72 and cross-member 74 provide an anchoring position for a lower leg bracket 76*b* to which the legs 16 are pivotally attached. An upper leg bracket 76*a* closely resembles the lower leg bracket 76*b*. The legs 16 are also pivotally attached to the upper leg bracket 76*a*. The upper and lower leg brackets 76, in combination with the legs 16 form a parallelogram linkage. A tray 94 is attached to the upper leg bracket, and a table top 78 is hingedly attached atop the tray 94.

One advantage of the walker 70 and all the height-adjustable furnishings over traditional vertically adjustable tables is that the table legs 16 adjust on a radial path because they are pivotally attached at the upper leg bracket and the lower leg bracket 76. Therefore, when the table top 78 is adjusted upward or downward, it remains horizontal. In addition, as the table top 78 is lowered, it also moves toward the user, who may be in a wheelchair or other type of seating. Due to this radial movement, the user does not have to sit up to use the table top 78. This is a tremendous advantage because many users who are in wheelchairs or other seating may not be able to sit up easily. The walker 70 provides a very helpful solution.

The base 72 of the unit is generally U-shaped, which allows the straight legs of the base to surround a wheelchair, and still provide excellent support for the adjustable table top 78 as it is adjusted down and forward. Many of the other purpose-specific furnishings defined herein can also be adapted for use with a wheelchair by widening them and assuring that ample space exists to surround a wheelchair base.

The walker 70 also serves as a height adjustable walker. The table top 78 includes a pair of handles 80 with a pair of brake levers 82 immediately adjacent. The brake lever 82 can be selectively activated, left or right or both, to operate brakes 84 at two of the wheels. To aid in mobility, two wheels 86 are fixed and do not caster. The remaining wheels 88 are casters.

The vertical height of the table top 78 can be adjusted so as to provide an optimum handle height when the unit is used as a walker. The height adjustment mechanism is beneath the table top 78 to avoid accidental adjustments and includes an adjustment lever 90 which is linked via a cable to a release lever which is mounted to a gas spring height adjuster 32. The "U" shaped base also provides excellent support when the unit is being used as a walker.

In order to adjust the vertical height of the table top 78, the base 72 must first be prevented from rolling toward the seated user. Where possible, the seated user's feet are used to hold the base 72 of the walker 70 and prevent it from rolling forward, thereby allowing the gas spring 32 to be collapsed by pulling the table top 78 forward while activating the adjustment lever 90. In situations where the user may not be able to use his feet to stop the base 72, a set of wheelchair stops 92 can be mounted to the base 72. These wheelchair stops 92 contact the foot rests of the wheelchair and stop the forward travel of the base 72 so that the gas spring 32 can be collapsed, thereby allowing the table top 78 to be pulled forward and lowered.

When the base 72 is stopped from rolling forward, the adjustment lever 90 is activated and the table top 78 is pulled downward and forward simultaneously. When the table top 78 is adjusted to the desired height, the adjustment lever 90 is released, which blocks the gas spring 32, thereby holding the table top 78 in the desired position.

To adjust the table top 78 back to its fully raised position, the adjustment lever 90 is activated and the table top 78 is pushed up slightly, if necessary. The stored energy within the gas spring 32 will cause the table top 78 to rise back to the fully upright position, unless the adjustment lever 90 is released prior to the table top 78 reaching the fully upright position. In this case, the table top 78 will stop and remain in whatever position it is in when the adjustment lever 90 is released.

The table top 78 has a recess 92 in the center that will hold a standard-sized cafeteria tray in a stationary position. The table top 78 is affixed to the tray 94 with a piano hinge 96. A small, self-activating latch 98 is mounted under the forward end of the table top 78 and serves to hold the table top 78 closed. The self-activating latch 98 must be manually overridden in order to open the table top 78 and expose the tray 94 beneath. The tray 94 may be used to hold personal belongings, such as a hairbrush, toothbrush, toothpaste, make-up, etc. A small gas strut 100 is shown mounted between the table top 78 and the tray 94 to control the table top's movement. The strut 100 assists in lifting and holding the table top 78 open. When the table top 78 is in the open position, a vanity mirror 102 mounted to the underside of the table top 78 can be seen.

To close the table top surface, the gas strut 100 between the table top 78 and the tray 94 is defeated by pushing down on the table top 78. When the table top 78 is folded down to the horizontal position, the latch 98 will self-activate. This latch can be manually overridden to open the table top 78 again.

Figure 8C:
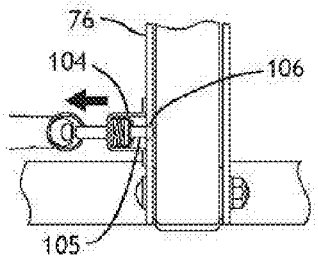
FIGS. 8C-E show detail views of a locking pin 104 assembly for the height-adjustable table, according to the present invention.
Figure 8D:
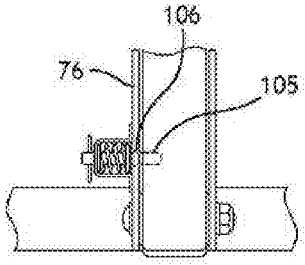
Figure 8E:
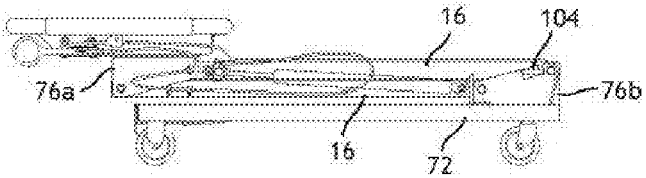

FIGS. 8C-D show detail views of a locking pin 104 assembly for the height-adjustable table. Vertical travel of the table top 78 is limited by a plunger-style locking pin assembly 104. The spring-loaded locking pin 105 is mounted to the rearward side of the lower leg bracket 76*b*. When the spring-loaded locking pin 105 is in its natural position and the table top 78 is in the fully upright position, the spring-loaded pin 105 protrudes through a hole 106 in the lower leg bracket 76. In this position, the pin 105 restricts the walker 70 from folding down past the lowest usable adjustment height. When the spring-loaded locking pin 105 is pulled out of the path of the rearward table leg 16 and the adjustment lever 90 is pulled (FIG. 8C), the leg 16 is allowed to pass the pin 105, thereby allowing the table top 78 to be folded to a flat, fully stowed position (See FIG. 8E). When the table top 78 is folded down to the stowed position and the locking pin 105 is released (FIG. 8D), the locking pin 105 engages a hole 106 in the rearward leg 16 of unit, thereby locking the legs 16 and the entire walker 70 in the stowed position. This keeps the unit from opening when the walker 70 is picked up and turned on its side. In order to return the unit to the fully upright position, the locking pin 104 is pulled out while the adjustment lever 90 is engaged and the tray 94 is lifted. As the tray 94 is lifted, the energy of the gas strut 100 will assist in returning the table top 78 to the fully upright position.

Similar to the baby highchair 10, when the table top 78 is in the fully upright position, the two legs 16 are angled approximately 10 degrees forward of vertical. The angling of these two legs 16 provides multiple advantages. It provides a mechanical advantage for the user when pulling the table top surface downward for adjustment, and it provides added stability when the unit is being used as a walker.

The table top 78 is vertically adjustable from the fully upright position (approximately 10 degrees forward of vertical) to a stowed position in which the two legs 16 fold down to an approximately horizontal position. The upper leg bracket and the lower leg bracket 76 that capture the two legs 16 are designed with offset pivot points, so as to allow one leg 16 to lay flat against the other leg 16 when stowing the walker 70. When the two legs 16 are folded to the approximately horizontal (stowed) position, the two opposing cavities 160 of the legs 16, which are made from "C" channel, form a cavity in which the gas strut 100 resides.

The features and functions described above combine to form a versatile combination healthcare table and walker 70 that has many applications in ADA compliance, healthcare, geriatric and beriatric market sectors.

Figure 9:
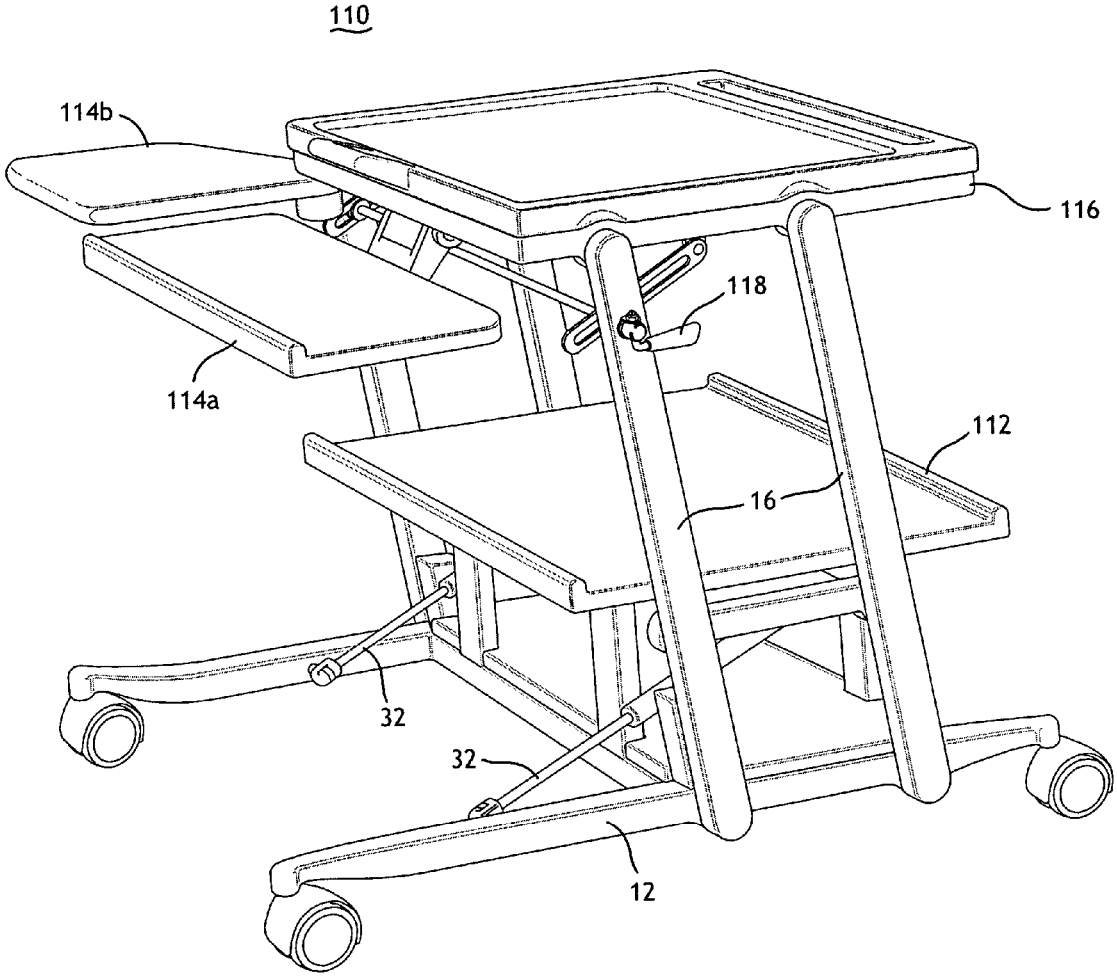
FIG. 9 is a perspective view of a four-legged, adjustable-height computer table, according to the present invention.

FIG. 9 shows a four-leg computer table 110. This variation of the height adjustable furnishing is similar to the baby highchair 10 with the exception of the lower storage shelf 112, the keyboard shelf 114*a* and mouse shelf 114*b* and the top shelf 116 which is adapted to hold a computer monitor and CPU. There are four legs 16 pivotally attached to the base 12 and the upper shelf 116 to form a parallelogram. A computer monitor on the upper shelf 116 may be adjusted up or down to suit the user's requirements. A pair of gas springs 32 provides energy to assist the user in making height adjustments.

The computer desk 110 is shown with a friction clamp locking mechanism 118. This friction clamp locking mechanism 118 is used on all four-leg tables unless the gas spring system with integrated blocking capabilities is used on a four leg table. Similarly, the friction clamp mechanism 118 can be used on the baby highchair 10. The walker 70, when configured with a gas spring that does not have integrated blocking capabilities, will utilize a version of this friction clamp locking device which is designed to lock between the table top and a single leg 16.

Figure 10A:
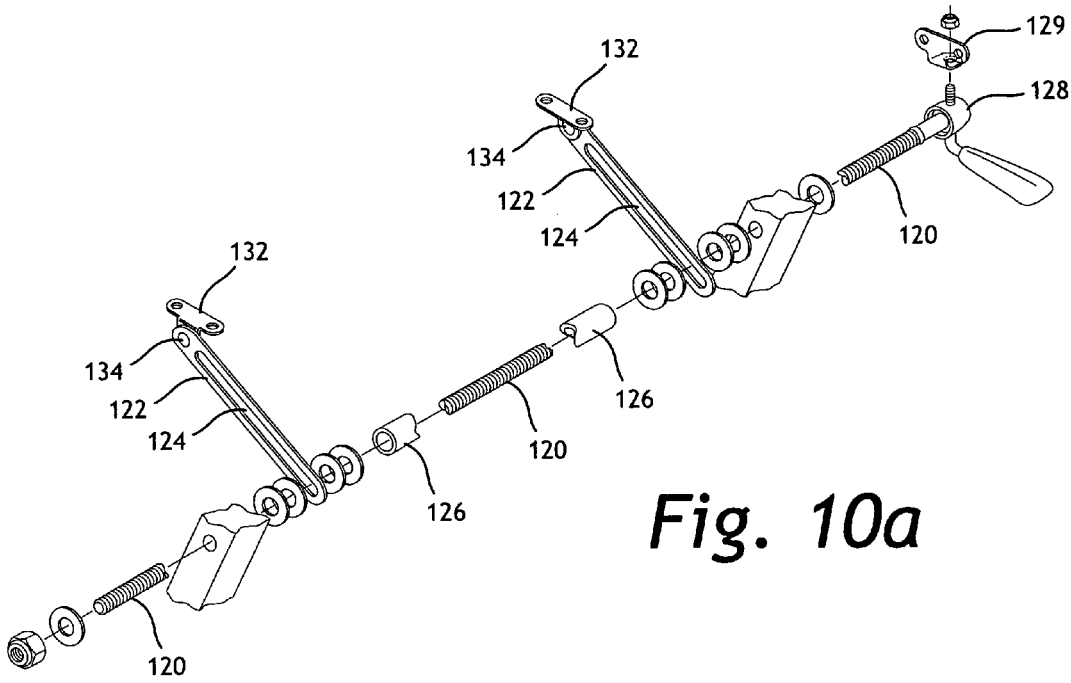
FIG. 10 shows perspective exploded views of two variations of a friction clamp mechanism, according to the present invention.
Figure 10B:
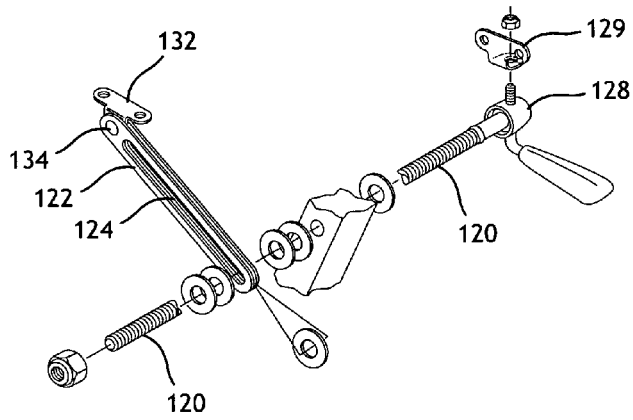

FIGS. 10*a* and 10*b* show exploded views of the friction clamp mechanism 118. FIG. 10*a* depicts a friction clamp mechanism 118 for clamping two legs, such as with a four-leg table. FIG. 10*b* depicts a friction clamp mechanism 118 for a two-leg table. A rod 120 extends through the both the front or the rear legs 16 and a pair of travel limiters 122. Each of the travel limiters 122 includes a slot 124 through which the rod 120 is routed. A hollow spacer tube 126 is also placed over the rod 120 between the pair of travel limiters 122. A cam-clamp 128 is fixed to one end of the rod 120 and a lock nut 130 is threaded to the other end of the rod 120. A plurality of plastic and or metal washers are placed on the rod 120 to provide separation between the lock nut 130, the first leg 16, the first travel limiter 122, the spacer tube 126, the second travel limiter 122, the second leg 16 and the cam clamp 128. The spacer tube 126 is cut to closely match the spacing between the legs 16.

As the cam clamp 128 has a handle or lever that is rotated about 180 degrees between fully opened and fully closed. It is similar to the quick-release skewer on a bicycle wheel. As the cam clamp 128 is opened, a few millimeters of slack are added to the rod 120.

At this point the rod 120 is free to move within the slot 124 of the travel limiter 122. One end of the travel limiter 122 includes an anchor 132 on a pivot 134. The anchor 132 portion is fixed to the underside of the upper shelf 116 (see FIG. 9) and provides a finite amount of adjustment down and toward the user or up and away from the user. When properly adjusted, the slot in the travel limiter 122 does not, in and of itself, limit the travel of the unit at all. The slot 124 is long enough on either end of the range of travel so that it never mechanically limits any travel, except when the cam clamp 128 acts upon it. When in the desired position, the cam clamp 128 is closed, tightening the entire friction clamp mechanism 118 and trapping the legs 16, travel limiters 122, spacer tube 126 and all the washers. The spacer tube 126 prevents the legs 16 being deflected so that the clamp 118 can be effective. A bracket 129 is attached to the cam clamp 128 and the adjacent table leg and prevents the cam clamp 128 from spinning.

Figure 11A:
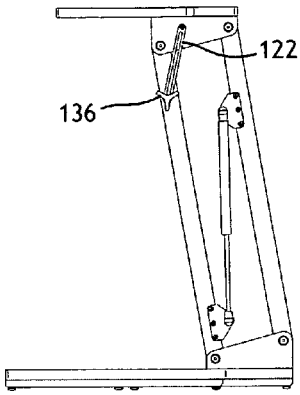
FIGS. 11A-D show side and perspective views of a two-leg TV table, with a thumbscrew clamp, according to the present invention.
Figure 11B:
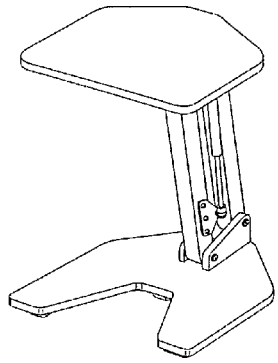
Figure 11D:
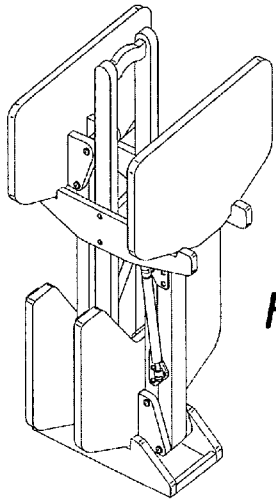
Figure 11C:
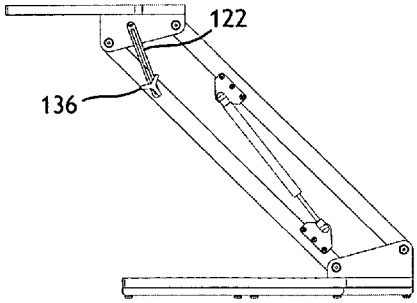
Figure 11E:
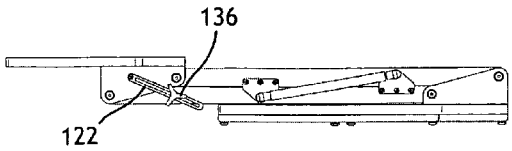
FIGS. 11E-F show perspective views of a folded TV table and rack stand, according to the present invention.
Figure 11F:
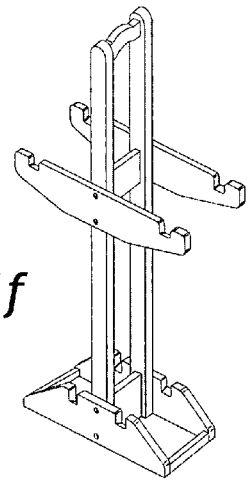
Figure 12A:
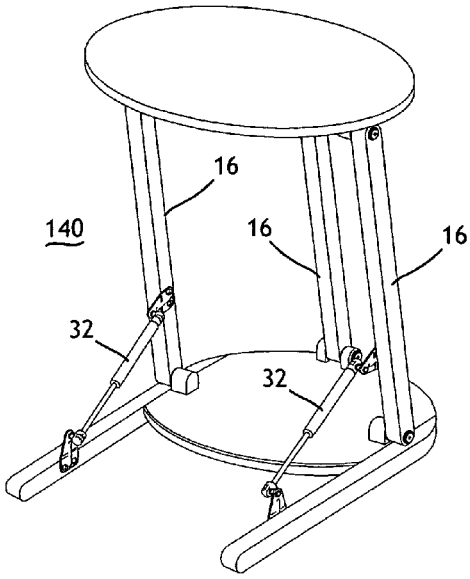
FIGS. 12A-D show side and perspective views of three-legged table, according to the present invention.
Figure 12B:
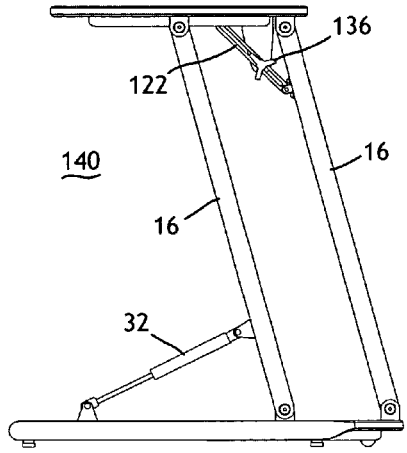
Figure 12C:
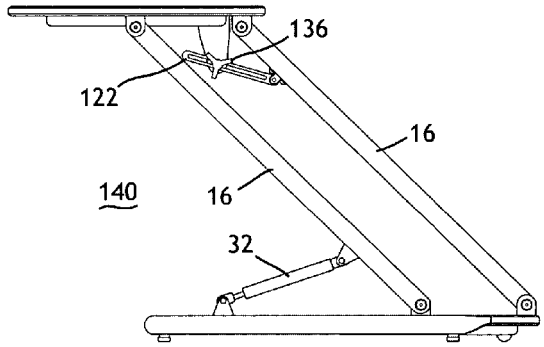
Figure 12D:
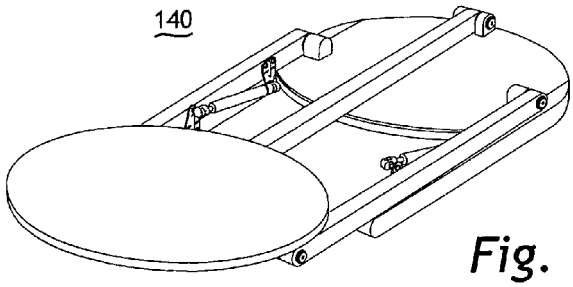
Figure 13A:
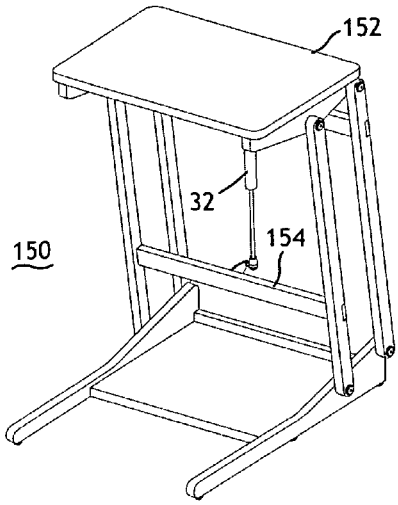
FIGS. 13A-D show side and perspective views of a four-leg TV table, according to the present invention.
Figure 13B:
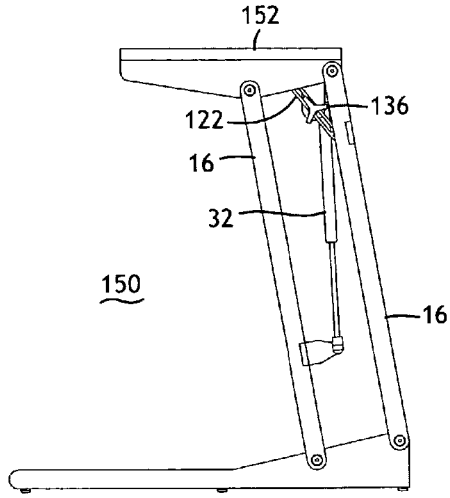
Figure 13C:
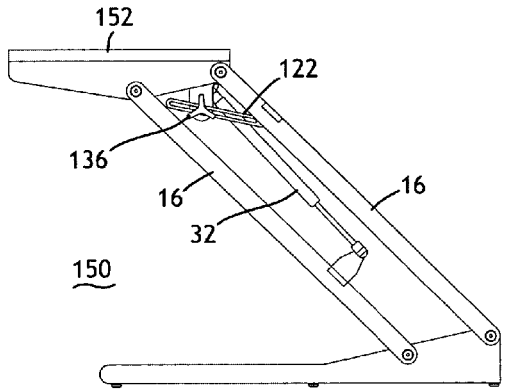
Figure 13D:
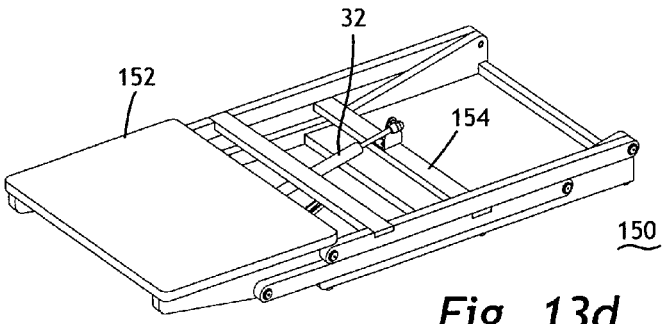

FIGS. 11A-E show a two-leg TV table, with a thumbscrew clamp 136. The thumbscrew 136 is loosened to raise or lower the table, and the entire table can be folded flat for storage. This table uses the two-leg support principle from the walker 70, as well as the single leg travel limiter 122, but with a thumbscrew 136 instead of the cam clamp 128. FIG. 11D shows a folded TV table stored on a rack stand and FIG. 11F provides a view of the rack stand itself. The tables have great utility and are unobtrusive even when they are folded and stowed.

FIGS. 12A-D show a unique three-legged table 140. When seen from the side, in FIG. 12B, the thumbscrew 136 adjuster is visible. Also, it is evident that the same parallelogram linkage is present, even though the legs 16 are not in pairs. Like the previously shown two leg TV table, this three-legged table 140 folds flat for storage on a rack or separately.

FIGS. 13A-D show a four-leg TV table 150. This embodiment is similar to the two-leg and three-leg tables shown in FIGS. 11 and 12, but notice that the gas spring 32 is attached between the table top 152 and a leg brace 154. Like the previously shown two leg and three leg tables, this four-legged table 150 folds flat for storage on a rack or separately.

Figure 14A:
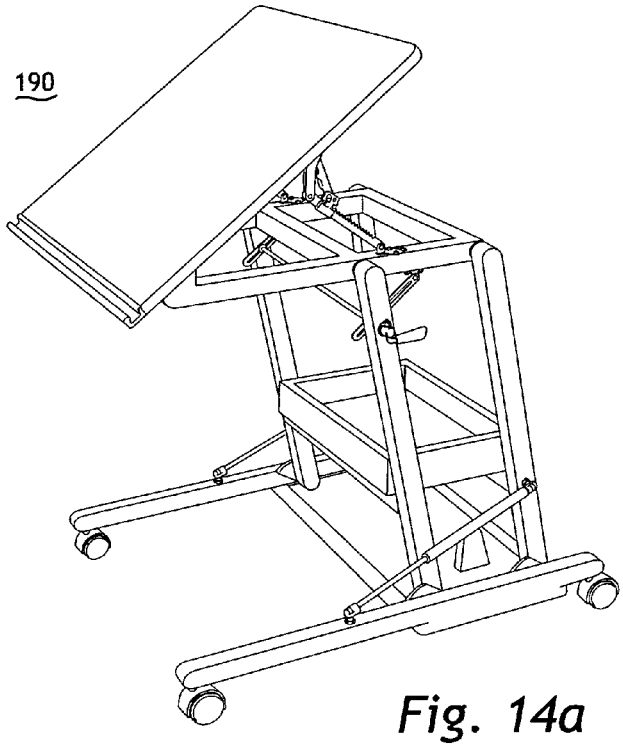
FIGS. 14A-C show side and perspective views of a drafting table, according to the present invention.
Figure 14B:
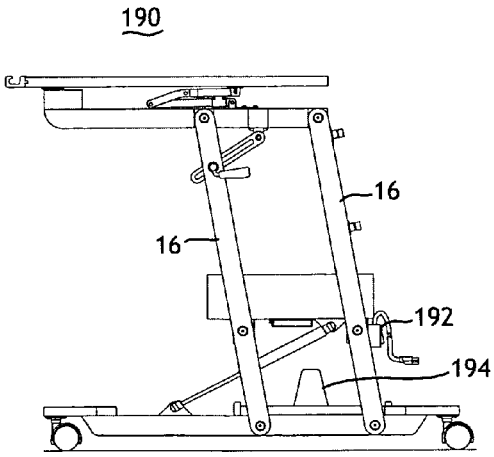
Figure 14C:
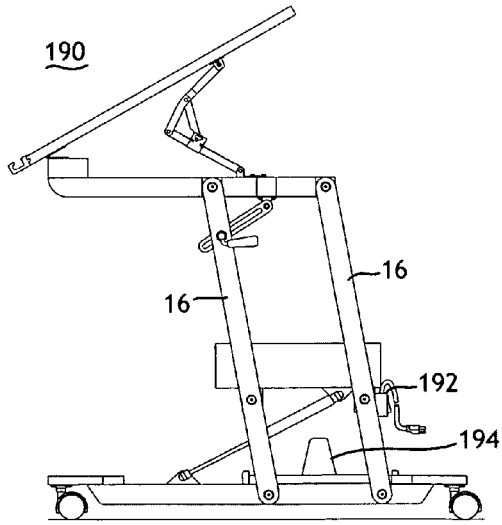

FIGS. 14*a-c* show how the computer desk theme 110 can be adapted for a drafting table 190. The drafting table 190 includes an electrical supply box 192. Also shown are a pair of stop blocks 194. The stop blocks 194 are attached to the base 12 in the same plane as the legs 16. The legs 16 are prevented from moving any lower than the limit imposed by the stop blocks 194. This is important where the table is heavy or supports a heavy load. The stop blocks 194 are screwed onto the base 12 and can be removed for storage of the unit, such as a computer table, drafting/art table or video game table.

Figure 15:
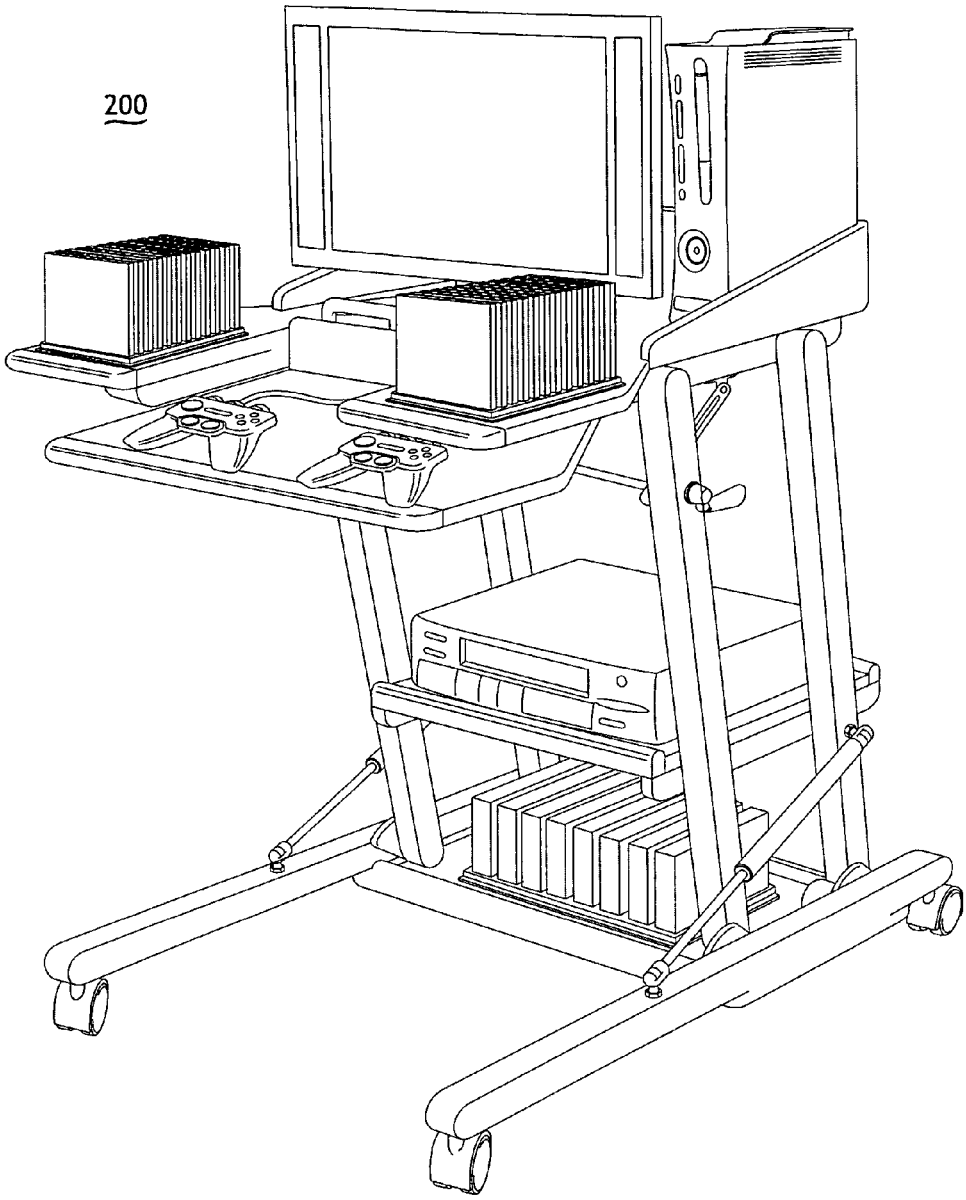
FIG. 15 shows a perspective view of a video game table, according to the present invention.

FIG. 15 shows a perspective view of a video game table 200 that operates on the four-leg principle. The video game table 200 provides accommodations for everything that is required to play video games in a compact, mobile package.

Figure 16:
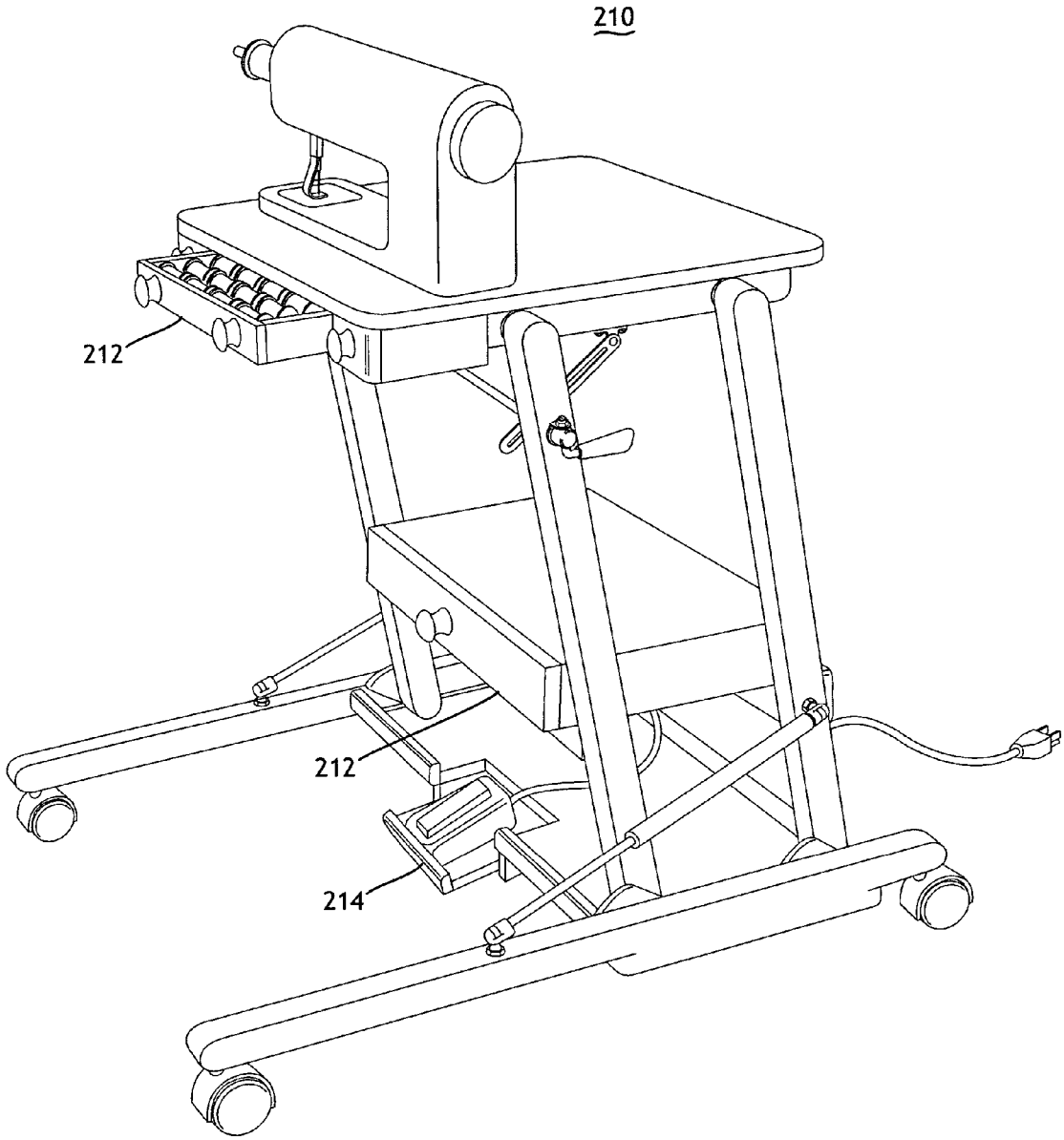
FIG. 16 shows a perspective view of sewing table, according to the present invention.

FIG. 16 shows a perspective view of a sewing table 210 that operates on the four-leg principle. The sewing table 210 provides drawers 212 for bobbins, thread and sewing supply storage and a tray 214 for the foot pedal.

While the description above refers to particular embodiments of the present invention, it will be understood that many modifications for specific uses may be made without departing from the spirit thereof. The accompanying claims are intended to cover such modifications as would fall within the true scope and spirit of the present invention.

We claim

1. A height-adjustable furnishing system comprising:

a horizontal base component having a top surface and a bottom surface, the bottom surface being generally planar, the top surface having a plurality of horizontally-arranged attachment points incorporated therein;

a plurality of leg members pivotally attached to the base component;

a height-adjustment mechanism attached between the base component and at least one of the plurality of legs; a gas spring; and a platform component pivotally attached to the plurality of legs, wherein the leg members are movable to provide simultaneous horizontal and vertical adjustability, wherein at their highest position the leg members are positioned approximately 10 degrees from vertical to provide some gravitational influence for the simultaneous horizontal and vertical adjustability, wherein the horizontal base is long enough to support the platform and prevent tipping of the system when the platform is at its lowest adjustment position and largest horizontal displacement, wherein throughout its adjustment range the platform remains parallel to the horizontal base, and wherein the horizontal base component, the leg members and the platform are foldable to a flat configuration.

2. The height-adjustable furnishing system of claim 1, where the base, legs and platform further comprise a parallelogram linkage.

3. The height-adjustable furnishing system of claim 1, where the plurality of legs is two.

4. The height-adjustable furnishing system of claim 1, where the plurality of legs is three.

5. The height-adjustable furnishing system of claim 1, where the plurality of legs is four.

6. The height-adjustable furnishing system of claim 1, where the height-adjustment mechanism comprises a variable mechanical advantage geometry.

7. The height-adjustable furnishing system of claim 1, where the height-adjustment mechanism comprises a cam clamp.

8. The height-adjustable furnishing system of claim 1, where the height-adjustment mechanism comprises a mechanical travel block.

9. The height-adjustable furnishing system of claim 1, where the mechanical travel block is foot-operated.

10. The height adjustable furnishing system of claim 1, where the height adjustment mechanism comprises a gas spring with integrated blocking capabilities.

11. The height-adjustable furnishing system of claim 10, where the height-adjustment mechanism comprises a cable release.

12. The height-adjustable furnishing system of claim 11, where the height-adjustment mechanism comprises a trigger release device mounted to the shaft of the gas spring with integrated blocking capabilities and captures an end of the cable release.

13. The height-adjustable furnishing system of claim 1, where the height-adjustment mechanism is foot-operated.

14. The height-adjustable furnishing system of claim 13, where the height-adjustment mechanism is gravity-operated.

15. The height-adjustable furnishing system of claim 1, where the legs are adjustable between zero degrees and ninety degrees from parallel with a floor.

16. The height-adjustable furnishing system of claim 15, where the plurality of legs are completely erect at approximately 10 degrees from vertical at the highest adjustment point.

17. The height-adjustable furnishing system of claim 1, where the entire system folds to a generally planar configuration.

18. The height-adjustable furnishing system of claim 17, where two of the plurality of legs are parallel and rest against each other in a stowed position.

19. The height-adjustable furnishing system of claim 18, where the plurality of legs comprise C-channels that are open toward each other to create a chamber that envelopes a gas spring height adjustment system.

20. A height-adjustable furnishing system, comprising:

a base component having a top surface and a bottom surface, the bottom surface being generally planar, the top surface having a plurality of attachment points incorporated therein;

a plurality of leg members pivotally attached to the base component;

a height-adjustment mechanism attached between a forward leg and a rearward leg of the plurality of legs; a gas spring; and a platform component pivotally attached to the plurality of legs, wherein the leg members are movable to provide simultaneous horizontal and vertical adjustability, wherein at their highest position the leg members are positioned approximately 10 degrees from vertical to provide some gravitational influence for the simultaneous horizontal and vertical adjustability, wherein the horizontal base is long enough to support the platform and prevent tipping of the system when the platform is at its lowest adjustment position and largest horizontal displacement, wherein throughout its adjustment range the platform remains parallel to the horizontal base, and wherein the horizontal base component, the leg members and the platform are foldable to a flat configuration.

* * * * *